US005769320A

United States Patent [19]

Stockert

[11] Patent Number: 5,769,320

[45] Date of Patent: Jun. 23, 1998

[54] INTENSIFIER CLEANING PROBE

[75] Inventor: David L. Stockert, New Boston, Mich.

[73] Assignee: Ingersoll-Rand Company, Woodcliff Lake, N.J.

[21] Appl. No.: 635,159

[22] Filed: Mar. 11, 1996

[51] Int. Cl.[6] ..... B05B 1/08

[52] U.S. Cl. ..... 239/92; 239/99

[58] Field of Search ..... 239/92, 99, 101, 239/100

[56] References Cited

U.S. PATENT DOCUMENTS

| | | | |
|---|---|---|---|
| 1,734,368 | 11/1929 | Cumner . | |
| 3,207,442 | 9/1965 | Kessler et al. | 239/92 |
| 3,362,618 | 1/1968 | Fortinov | 230/52 |
| 3,490,696 | 1/1970 | Cooley | 239/101 |
| 3,520,477 | 7/1970 | Cooley | 239/101 |
| 3,521,820 | 7/1970 | Cooley | 239/101 |
| 3,593,524 | 7/1971 | Chermensky et al. | 60/54.5 HA |
| 3,601,987 | 8/1971 | Chermensky et al. | 60/54.5 HA |
| 3,601,988 | 8/1971 | Chermensky et al. | 60/54.5 HA |
| 3,712,543 | 1/1973 | Clipp et al. | 239/99 |
| 3,784,103 | 1/1974 | Cooley et al. | 239/101 |
| 3,795,319 | 3/1974 | Luthi et al. | 210/409 |
| 4,074,858 | 2/1978 | Burns et al. | 239/172 |
| 4,077,569 | 3/1978 | Deines | 239/101 |
| 4,190,202 | 2/1980 | Yie | 239/101 |
| 4,231,283 | 11/1980 | Malburg | 89/8 |

*Primary Examiner*—Andres Kashnikow
*Assistant Examiner*—Steven J. Ganey
*Attorney, Agent, or Firm*—Walter C. Vliet; Leon Nigohosian, Jr.

[57] ABSTRACT

An intensifier cleaning probe is provided which compresses the cleaning fluid and delivers it through a central reciprocating cylinder rod which also serves to advance an attached cleaning rod with an engine oil passage or the like.

3 Claims, 1 Drawing Sheet

INTENSIFIER CLEANING PROBE

BACKGROUND OF THE INVENTION

This invention relates generally to fluid pressure intensifiers and more particularly to cleaning and flushing devices for drilled holes and the like. For example, auto makers are asking for cleaner engines especially, for example, the oil passages of cylinder blocks perform a critical function for the engine and are generally of limited diameter particularly in modern engines. The smaller passages are more easily blocked by debris left over from casting, finishing, and boring operations and it is therefore important that the residue of these operations are thoroughly cleaned from the engine passages. A typical parts washer sprays water in the range of 80 to 115 psi. Higher pressures normally become cost and maintenance prohibitive.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention this is accomplished by providing an intensifier cleaning probe comprising a first cylinder and a second cylinder disposed about a common longitudinal axis in end to end relationship each of the first cylinder and the second cylinder being provided with an outwardly facing head and an inwardly facing head relative to the other cylinder forming a first enclosed cylinder chamber and a second enclosed cylinder chamber in the first cylinder and the second cylinder respectively; a piston rod axially disposed through each of the first enclosed cylinder chamber and the second enclosed cylinder chamber for reciprocation therein; a first piston connected to the piston rod and cooperating with the first cylinder to form complimentary cylinder volumes upon reciprocation of the piston rod; a second piston connected to the piston rod and cooperating with the second cylinder to form complimentary cylinder volumes upon reciprocation of the piston rod; means for causing the second piston to reciprocate; and means for supplying a cleaning fluid to a first complimentary volume of the first enclosed cylinder complimentary cylinder volumes for compression thereby and delivery through the cylinder rod as a cleaning media.

The mechanism according to the present invention will create a stream of cleaning fluid with a pressure range from 2,000 to 6,000 psi while at the same time delivering the high pressure cleaning fluid as it probes the drilled hole.

The foregoing and other aspects of the invention will become apparent from the following detailed description of the invention when considered in conjunction with the accompanying drawing figure.

BRIEF DESCRIPTION OF THE DRAWING FIGURE

FIG. 1 is a cross sectional view of an intensifier cleaning probe according to the present invention.

DETAILED DESCRIPTION

Figure 1:
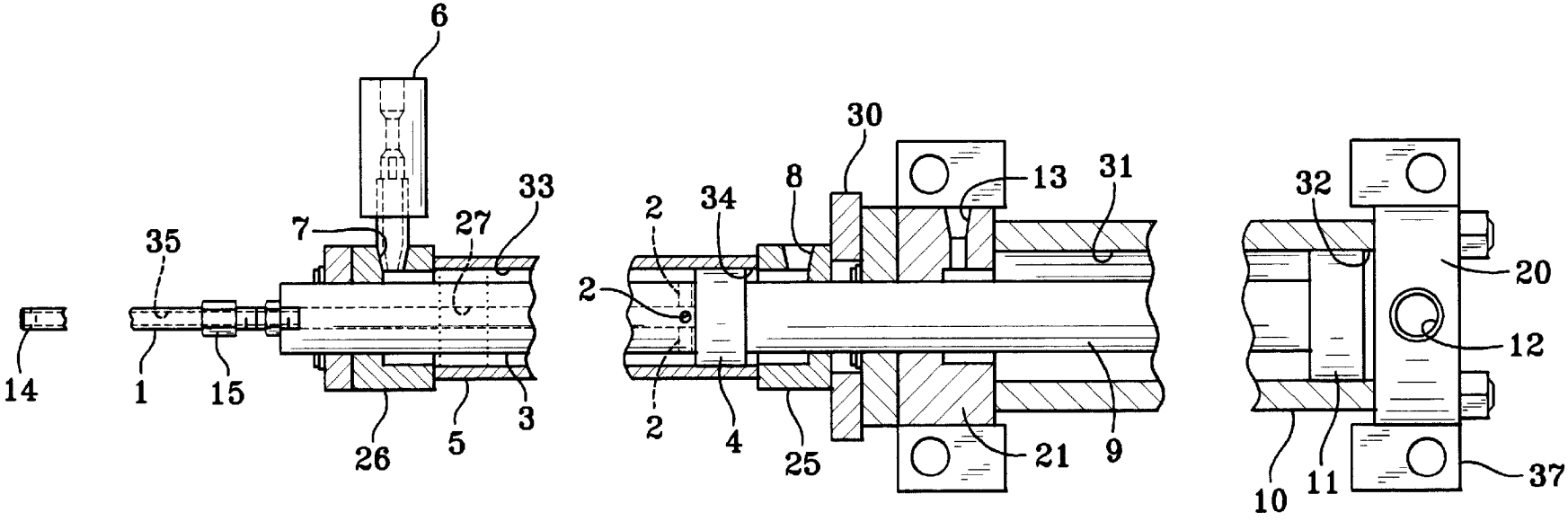

As shown in FIG. 1, the intensifier cleaning probe shown in cross section is generally comprised of an actuation cylinder 10 and piston 11 shown to the right or rear of FIG. 1 and a delivery cylinder 5 and piston 4 shown to the left or front of the device of FIG. 1. The pistons 4 and 11 share a common piston rod 9 having a hollow front portion 3. The piston rod 9 commonly reciprocates with both piston 4 and 11. The rear cylinder 10 is provided with an external head 20 and an intermediate head 21. Cylinder 5 is provided with an intermediate head 25 and a front external head 26. An intermediate head seal 30 is provided to prevent leakage along the pushrod 9. The delivery end 3 of pushrod 9 is provided with a central bore 27 which intersects a series of cross bores 2 for receiving the compressed cleaning fluid and delivering it to a cleaning probe 1.

It will be appreciated by one skilled in the art that piston 11 forms two complimentary cylinder volume chambers 31 and 32 upon reciprocation of the piston 11 with chamber 32 having a greater volume than chamber 31 which is reduced in its volume content by the cylinder rod 9. Likewise, piston 4 separates cylinder 5 into two complimentary (as one volume increases the other proportionally decreases) cylinder volumes 33 and 34. For purposes of the present invention, cylinder 10 is of greater diameter than cylinder 4, hence the area of piston 11 is greater than the area of piston 4 and the complimentary volumes 31, 32 are greater than the complimentary volumes 33, 34.

According to the preferred embodiment, I have chosen hydraulic fluid as the operating media of cylinder 10 and water as the cleaning fluid media in cylinder 5. In operation, hydraulic fluid enters the rear cylinder 10 through port 12 pushing the piston 11 to the left as shown in FIG. 1. The piston linked with cylinder rod 9 pushes the smaller piston 4 in the front cylinder 5. In operation, hydraulic fluid enters the rear cylinder 10 through port 12 pushing the piston 11 to the left as previously indicated. The piston linked with rod 9 pushes the smaller piston in front of cylinder 5. The difference in piston diameters and square areas available creates a larger pressure in cylinder 5. Water is piped through a check valve 6 and enters the cylinder through port 7.

As the complimentary cylinder volume 33 is decreased, the pressurized water enters the cross holes 2 and proceeds through the central bore 27 and the hollow center 35 of probe 1 to ultimately escape through directional cleaning slits 14. Complimentary cylinder volume 34 may be vented to atmosphere through port 8 or alternately pressurized to increase the available compression force. The probe returns when hydraulic fluid enters port 13 which in turn forces piston 11 back to its original location. The intensifier probe may be mounted by feet 37 provided on the cylinder heads.

It should now be appreciated by one skilled in the art that the intensifier cleaning probe not only provides the means for producing the compressed cleaning media but also provides the means for advancing the probe into a bored hole or the like to accomplish cleaning thereof. Hydraulic fluid, compressed air, or water can be utilized to pressurize the rear cylinder 10 and the cleaning fluid supplied to the front cylinder 3 may be of any desired cleaning fluid such as, for example, water or water containing detergent or hydrocarbon based cleaning solution and the like.

As shown in FIG. 1, the probe 1 is connected to the cylinder rod 9 at its delivery end 3 by means of a connector 15. This permits the ready replacement of the probe and design of the probe for a specific cleaning function. In the preferred embodiment, the intermediate heads 25 and 21 are shown as separate structures with an intermediate seal 30. It should be understood by one skilled in the art that a single intermediate head structure may be used incorporating an appropriate seal therein.

Having described my invention in terms of a preferred embodiment, I do not wish to be limited in the scope of my invention except as claimed.

What is claimed is:

1. An intensifier cleaning probe comprising:

a first cylinder and a second cylinder disposed about a common longitudinal axis in end to end relationship each of said first cylinder and said second cylinder being provided with an outwardly facing head and an inwardly facing head relative to the other cylinder forming a first enclosed cylinder chamber and a second enclosed cylinder chamber in said first cylinder and said second cylinder respectively;

a piston rod axially disposed through each of said first enclosed cylinder chamber and said second enclosed cylinder chamber for reciprocation therein;

a first piston connected to said piston rod and cooperating with said first cylinder to form complimentary cylinder volumes upon reciprocation of said piston rod;

a second piston connected to said piston rod and cooperating with said second cylinder to form complimentary cylinder volumes upon reciprocation of said piston rod;

means for causing said second piston to reciprocate;

means for supplying a cleaning fluid to a first complimentary volume of said first enclosed cylinder complimentary cylinder volumes for compression thereby and delivery through the piston rod as a cleaning media; and a cleaning probe communicating with said piston rod and reciprocating therewith wherein said cleaning fluid is further delivered by said cleaning probe.

2. An intensifier cleaning probe according to claim 1, wherein said second piston is reciprocated by means of compressed hydraulic fluid and said first piston compresses and delivers a water based cleaning solution.

3. An intensifier cleaning probe according to claim 1, wherein said cleaning probe is removably connected to said piston rod.

* * * * *